United States Patent [19]

Saputo

[11] Patent Number: 4,734,946

[45] Date of Patent: Apr. 5, 1988

[54] KNOCK DOWN FOUNDATION FOR A FLOTATION BED

[76] Inventor: Richard A. Saputo, 19577 Rosita St., Tarzana, Calif. 91356

[21] Appl. No.: 5,911

[22] Filed: Jan. 21, 1987

[51] Int. Cl.[4] ..... A47C 19/00

[52] U.S. Cl. ..... 5/400; 5/201; 5/282 R; 5/285; 5/286

[58] Field of Search ..... 5/400, 401, 451, 201, 5/200 R, 200 C, 200 B, 282 R, 285, 286

[56] References Cited

U.S. PATENT DOCUMENTS

| | | | |
|---|---|---|---|
| 3,727,246 | 4/1973 | Germano | 5/282 R |
| 4,077,074 | 3/1978 | Fogel | 5/451 |
| 4,186,452 | 2/1980 | Underwood | 5/400 |
| 4,391,008 | 7/1983 | Yamaoka et al. | 5/200 R |
| 4,597,117 | 7/1986 | Sumner | 5/308 |
| 4,613,999 | 9/1986 | Franco et al. | 5/400 |

*Primary Examiner*—Alexander Grosz

*Attorney, Agent, or Firm*—Poms, Smith, Lande & Rose

[57] ABSTRACT

A knock down foundation for a flotation sleep system comprising a plurality of interlocking sections combining to form a rectangular base. A planar support made up of separate parts may be disposed over the base covering substantially the entire exposed sheet. A soft-sided waterbed or other sleeping systems is then laid on top of the sheet. A plurality of feet are provided on the undersurface of said sections for supporting the base on a supporting surface. Headboard brackets are provided at one end of the base for attaching a headboard thereto. A plurality of hooks are provided on the bottom of the sections at spaced locations for receiving grommets of upholstery thereon. The sheet and headboard brackets may be fastened to the sections by screws or the like. The entire apparatus can be quickly and easily knocked down or set up, is light in weight and easy to ship in a compact form.

7 Claims, 2 Drawing Sheets

KNOCK DOWN FOUNDATION FOR A FLOTATION BED

BACKGROUND OF THE INVENTION

1. Field of the Invention

The invention relates to flotation beds; and, more particularly, to a knock down foundation for a flotation bed.

2. Description of the Prior Art

Waterbeds or flotation sleep systems are quite popular but are generally sold in specialty stores dealing exclusively in such beds. In recent years, discount houses have opened up having low overhead and selling goods without frills or special services. However, such stores have not sold waterbeds or flotation sleep systems due to the bulk and complex nature of such sleep systems.

Thus, there is a need for a waterbed that can be sold in a kit form having a knock-down lightweight foundation. Such foundation should be shippable in an elongated form of crated individual parts that can be assembled quickly and easily to form the foundation. Present flotation bed foundations are rigid structures constructed of wood or wood by-products and set upon metal frames or other riser or pedestal supports. Since such foundations are rigid, they cannot be disassembled for shipping and occupy and substantial amount of shipping space, as for example, up to 27 cubic feet. For example, some present queen sized flotation beds may be shipped in two cartons occupying 44 cubic feed in a 45 foot long trailer having a capacity of 3000 cubic feed. Thus, only 68 such beds could be shipped. However, if these beds could be knocked down, appreciably more such beds could be shipped in the same trailer, as for example, 136 such beds resulting in considerable freight savings. Such savings could then be passed on to the customer at a discount warehouse or the like. The container for such a knock down bed could be designed so that a customer could go into such a warehouse or other mass merchandiser, buy it off the shelf and quickly and easily set it up.

Thus, there exists a need for such a knock down lightweight foundation for water beds, air beds or other flotation beds.

SUMMARY OF THE INVENTION

It is an object of this invention to provide a lightweight knock down foundation for a waterbed, air bed or other flotation sleep systems.

It is a further object of this invention to provide such foundation which, when unassembled, occupies a space considerably less than the sapce it occupies when assembled.

It is still another object of this invention to provide such a foundation which is quick and easy to assembly and disassemble.

These and other objects are preferably accomplished by providing a knock down foundation for a flotation bed comprising a plurality of interlocking sections combining to form a rectangular base. A planar support made up of separate parts may be disposed over the base covering substantially the entire exposed surface. A softsided waterbed or other sleep system is then laid on top of the support. A plurality of feet could be provided on the undersurface of said sections for supporting the base on a supporting surface or the rectangular base could be supported by a separate metal frame, riser or pedestal. Headboard brackets are provided at one end of the base for attaching a headboard thereto. A plurality of hooks are provided on the bottom of the sections at spaced locations for receiving grommets of upholstery or ticking thereon. The sheet and headboard brackets may be fastened to the sections by screws or the like. The entire apparatus can be quickly and easily knocked down or set up, is light in weight and easily shippable in a compact form.

DESCRIPTION OF THE PREFERRED EMBODIMENT

Figures 1, 2, 3:
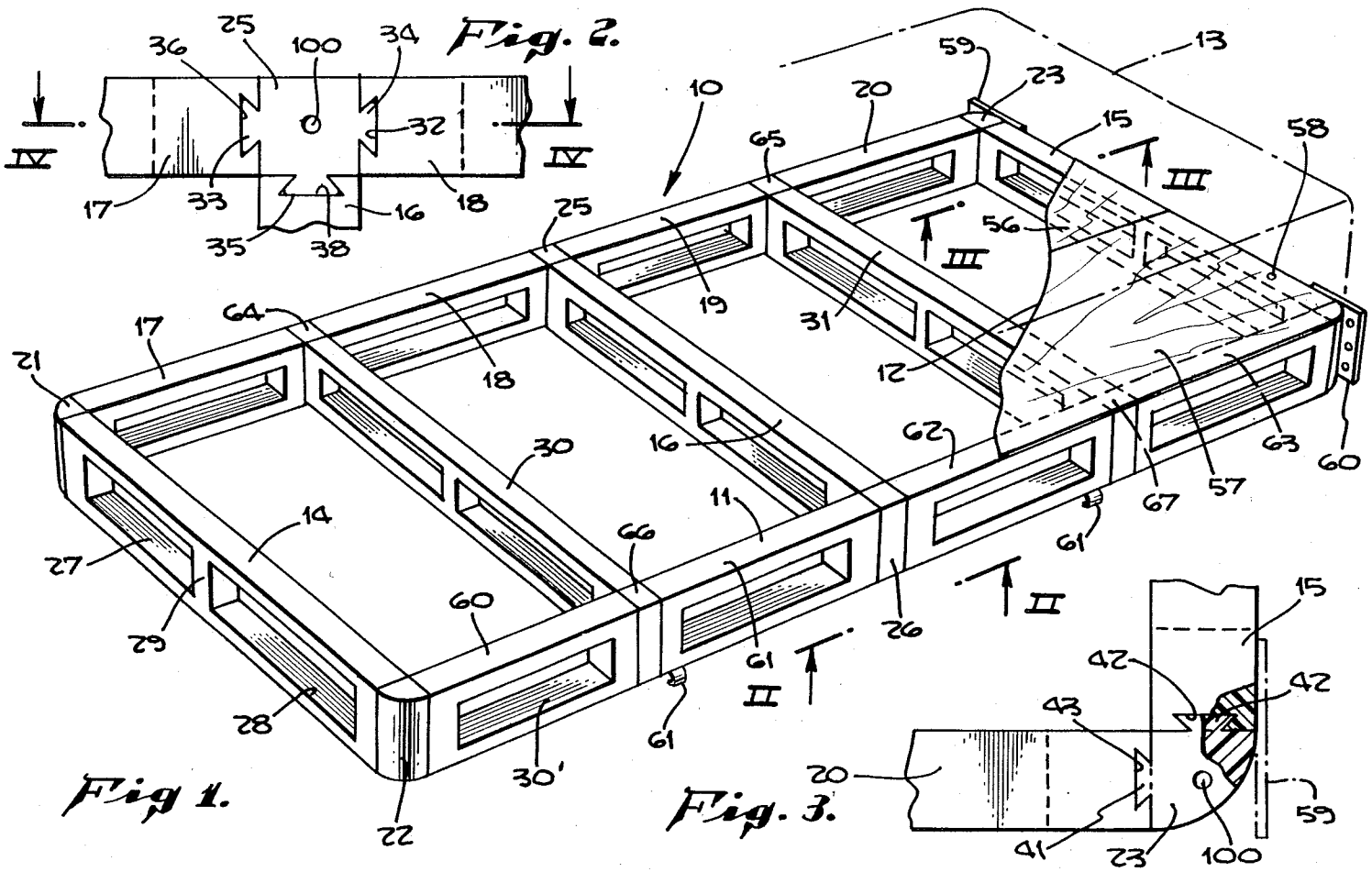
FIG. 1 is a perspective view of an assembled knock down sleep system foundation in accordance with the teachings of the invention.
FIG. 2 is a bottom plan view of a portion of the foundation of FIG. 1 showing interconnection of parts thereof.
FIG. 3 is a bottom plan view, partly in section, of a corner of the foundation of FIG. 1.

Referring now to FIG. 1 of the drawing, a knock down lightweight foundation 10 is shown having a frame 11, made up of interconnected parts and a platform 12 overlying the frame 11. A waterbed or other sleep system 13 is shown in phantom adapted to rest on top of platform 12. Although foundation 10 is disclosed as usable with a waterbed, obviously it can be used wityh any softsided waterbed, airbed or other flotation sleep systems, as long as it is sufficient to support the weight. Such systems may have water depths ranging from under 4" to over 9".

As seen in FIG. 1, frame 11 is comprised of a plurality of interlocking sections as end sections 14, 15, med sections 16, 30, 31 side sections 17 through 20, and 60 through 63, corner connectors 21 through 24, and side connectors 25, 26, 64 through 67. Of course, these sections could be broken down durther (that is, for example, end sections 14, 15 may be made up of two or more interconnected sections, etc.).

Sections 14, 30, 16, 31 and 15 may have open window areas (as areas 27, 28 in section 14) separated by a common wall 29. Sections 17–20 and 60–63 may have an open area 30' as shown in section 60. For ease of manufacture, end sections 14, 15 and mid sections 16, 30, 31 may be identical and of the same length. In like manner, side supports 17 to 20 and 60–63 are also identical. The overall lengths and widths of each set may vary depending on the size of bed desired.

Figure 4:
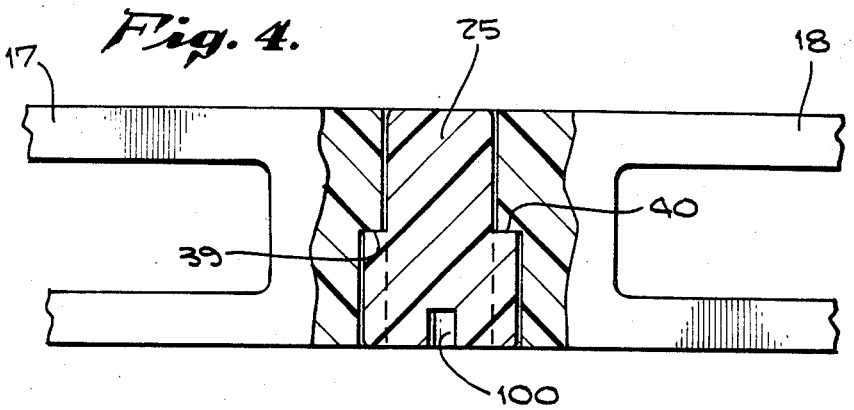
FIG. 4 is a view, partly in section, taken along lines IV—IV of FIG. 2.
Figure 5:
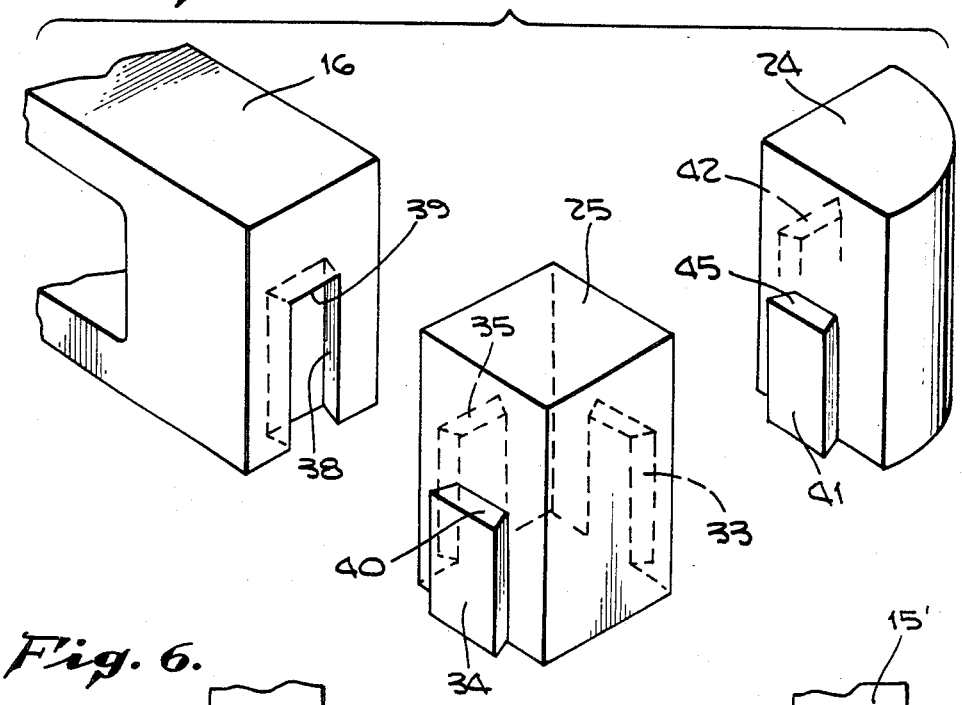
FIG. 5 is an exploded view of parts of the foundation of FIG. 1 illustrating the interlocking feature thereof.

As seen in FIG. 2, side connector 25 (connector 26 and 64–67 being identical) is a block-shaped member having trapezoidally-shaped tongues 33 through 35 adapted to be inserted into like shaped grooves 36 through 38, respectively (see also FIG. 5). As seen in FIG. 5, these grooves 36 through 38 terminate at a point slightly past the middle of each member, as at wall 39, conforming to the wall 40 of each tongue 33 through 35 thus providing for both quick insertion and assembly and a flush relationship at their mating surfaces (see FIG. 4). The overall width of the interlocking members at the base support legs (FIG. 4) provides a solid stable support.

The corner members 21 to 24 interconnect in a similar manner as can be seen in FIGS. 3 and 5. Thus, each corner member, such as member 23 in FIG. 3, has a trapezoidally-shaped tongue 41, 42 at each side adapted to engage like shaped grooves 43, 44 in members 20, 15 respectively. These tongues 41, 42 terminate at wall 45 as seen in FIG. 5 and grooves 43, 44 in members 14, 15 and 17, 20, and 60, 63 terminate in a wall similar to groove 38 in member 16 in FIG. 5 and further discussion is deemed unnecessary. The mating leg supports form a solid corner at each corner of the frame 11 and a flush upper surface.

Figure 6:
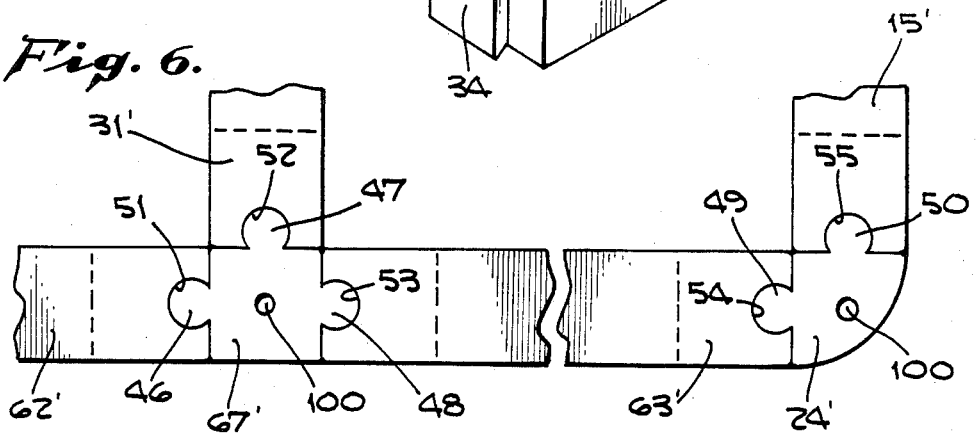
FIG. 6 is a bottom plan view of a modified interconnecting means for the foundation of FIG. 1.

Although a particular type of tongue and groove interlocking means has been described, any suitable irregularly shaped interlocking means may be used. For example, as seen in FIG. 6, the primed numerals refer to like parts of the frame 11 of the embodiment of FIG. 1. However, the specific tongue and groove arrangement of FIG. 1 has been replaced by rounded projections 46 through 50 on corner connectors 24' and side connectors 26' engaging like configured rounded grooves 51 through 55 on corner connectors 24' and side connectors 26'. It is to be understood that the bottom walls of grooves 51 to 55 and projections 46 to 50 terminate similarly to walls 40, 39, 45 as heretofore discussed. In this manner, a modified interlocking arrangement is disclosed.

The platform 12 (FIG. 1) is comprised of a plurality of elongated flat planar sheets, such as two sheets 56, 57, to provide a firm flat support for bed 13. These sheets 56, 57 may be of plastic, honeycomb, or wood or any other suitable material and of a suitable thickness to support bed 13. These sheets 56, 57 may be secured to frame 11 by suitable screws 58 or other suitable attaching means. Brackets 59, 60 are provided, secured to frame 11 by plastic screws or the like, at each side of the front end of frame 11 for securing a suitable headboard thereto. Further, brackets (not shown) may be provided for attaching a footboard.

A plurality of protrusions or hooks 61 may be provided on the underside of frame 11, as on one or more of the side supports, facing inwardly toward the central longitudinal axis of the frame 11. These hooks 61 are engaged by grommets or loops on the conventional bedding or upholstery that the user will wrap around the bed 13, platform and frame 11 when assembled. Also, if desired, flexible sheeting (not shown) may be provided between the platform 12 and bed 13. Also, as seen in FIGS. 2, 3, 4 and 6, holes 100 may be provided in the underside of the various parts for insertion of adjustable feet (not shown).

The various supports and platform 12 may be comprised of injection molded or other manufacturing process materials, such as plastic, or may be of wood, wood substitutes, metal, etc. However, plastic is preferred for its lightweight features.

The foundation 10 can be quickly and easily knocked down or assembled. When knocked down, one foundation 10 can occupy one half the cubic feet space of a conventional box foundation resulting in considerable savings in shipping. The parts may be collapsed to a stack of components less than eight inches in height and can be shrink wrapped for shipping. An entire flotation sleep system or waterbed could be shipped in a single carton.

The invention is applicable to all such flotation beds, such as a hybrid waterbed, flotation sleep systems and/or softsided waterbeds.

Although a tongue and groove connection has been disclosed for the various supports, obviously any suitable interlocking means may be used.

I claim:

1. In a knock down lightweight foundation for a flotation bed comprising:

a plurality of elongated side supports;

first removable interconnecting means associated with a first pair of said side supports to form a linear first side of said foundation;

second removable interconnecting means associated with a second pair of said supports to form a linear second side of said foundation;

a pair of elongated end supports;

third removable interconnecting means associated with one end of said first side of said foundation interconnecting said first side with one of said end supports;

fourth removable interconnecting means associated with one end of said second side of said foundation interconnecting said second side to the free end of said one of said end supports;

fifth removable interconnecting means associated with the other end of said first side of said foundation interconnecting said first side with the other of said end supports;

sixth removable interconnecting means associated with the other end of said second side of said foundation interconnecting said second side with the free end of said end supports thereby forming an open rectangular framework; and a mid support extending between said first and second sides, said first and second removable interconnecting means also being removably interconnected to the free ends of said mid support, said first interconnecting means including a block having a first tongue thereon extending in a direction toward one end of said mid support, a second tongue extending in a direction toward one of said side supports on said first side and a third tongue extending in a direction toward the other of said side supports on said first side, and said second interconnecting means includes a block having a first tongue thereon extending in a direction toward the other end of said mid support, a second tongue extending in a direction toward one of said side supports on said second side, and a third tongue extending in a direction toward the other end of said side supports on said second side, and grooves on said mid support and said side supports receiving said tongues therein.

2. In the foundation of claim 1 including a flat planar generally imperforate platform disposed over the top surface of said framework forming a support for a flotation sleep system.

3. In the foundation of claim 2 wherein said platform is comprised of a plurality of elongated sheets secured to said framework.

4. In the foundation of claim 1 wherein said tongues extend partway down said blocks and said grooves extend partway down said mid support and said side supports.

5. In the foundation of claim 1 wherein said third interconnecting means includes a block having a first tongue thereon extending in a direction toward one end of one said end supports, and a second tongue extending in a direction toward one end of one said side supports on said first side, and said fourth interconnecting means includes a block having a first tongue thereon extending in a direction toward the other end of one of said end supports, and a second tongue extending in a direction toward one end of one of said side supports on said second side;

said fifth interconnecting means includes a block having a first tongue thereon extending in a direction toward one end of the other of said end supports, and a second tongue extending in a direction toward the other end of said one of side supports on said first side, and said sixth interconnecting means includes a block having a first tongue thereon extending in a direction toward the other end of the other of said end supports; and a second tongue extending in a direction toward the other end of said one of side supports on said second side, and grooves on said end supports and the other ends of said side supports receiving said last-mentioned tongues therein.

6. In the foundation of claim 5 wherein said last-mentioned tongues extend partway down said blocks and said last-mentioned grooves extend partway down said end supports and said side supports.

7. In the foundation of claim 1 wherein all of said supports are of injection molded plastic material.

* * * * *